United States Patent [19]

Bailey et al.

[11] 4,230,041

[45] Oct. 28, 1980

[54] EXPLOSIVE FUZE CORD

[75] Inventors: John R. W. Bailey, East Caulfield; Michael R. L. Carter, Templestowe; Richard Fox, Rosanna, all of Australia

[73] Assignee: ICI Australia Limited, Victoria, Australia

[21] Appl. No.: 924,064

[22] Filed: Jul. 12, 1978

[30] Foreign Application Priority Data

Aug. 1, 1977 [AU] Australia ..... PD1055

[51] Int. Cl.[3] ..... C06C 5/04; F42D 1/04

[52] U.S. Cl. ..... 102/27 R; 86/1 R

[58] Field of Search ..... 102/27 R; 86/1 R; 149/3, 14

[56] References Cited

U.S. PATENT DOCUMENTS

| | | | |
|---|---|---|---|
| 3,260,201 | 7/1966 | Kelly et al. | 102/27 R |
| 3,318,242 | 5/1967 | Griffith | 102/27 R X |
| 3,384,688 | 5/1968 | Gow et al. | 102/27 R |
| 3,407,731 | 10/1968 | Evans | 102/27 R |
| 3,428,502 | 2/1969 | Evans | 102/27 R X |
| 3,881,420 | 5/1975 | Smith et al. | 102/27 R X |
| 3,908,509 | 9/1975 | Kelly et al. | 102/27 R X |
| 3,945,320 | 3/1976 | Gibson et al. | 102/27 R |
| 3,995,525 | 12/1976 | Blair | 102/27 R X |

FOREIGN PATENT DOCUMENTS

| | | |
|---|---|---|
| 2198116 | 3/1974 | France . |
| 471433 | 9/1937 | United Kingdom . |
| 1016404 | 1/1966 | United Kingdom . |
| 1456281 | 11/1976 | United Kingdom . |

*Primary Examiner*—David H. Brown

*Attorney, Agent, or Firm*—Cushman, Darby & Cushman

[57] ABSTRACT

Fusecord having an exterior fibrous layer bonded to a thermoplastic sheath by adhesive derived from a water-bearing composition.

16 Claims, 2 Drawing Figures

EXPLOSIVE FUZE CORD

This invention relates to fusecord of the kind commonly employed for the transmission of detonation or flame in blasting and seismic prospecting operations. The invention also includes methods of manufacturing the fusecord.

Such fusecord usually comprises a core of incendiary or explosive material surrounded by non-explosive wrapping materials, for example, textile yarns and/or synthetic plastics materials. Thus detonating cord usually has a core comprising high explosive particles such as pentaerythritol tetranitrate (PETN) or cyclotrimethylene trinitramine (RDX) whilst safety fuse has a core which burns at a relatively slow rate and which usually comprises the well known black powder which is a mixture of charcoal, sodium or potassium nitrate and sulphur. The core is often encased in a thin envelope of paper or plastics film. Reinforcing yarns which may typically be derived from cellulose, glass, paper or synthetic polymers are applied around the envelope and a water-proof sheath of thermoplastics material is applied over the yarns usually by extrusion. The thermoplastics sheath is usually derived from rubbers or polyurethanes or from a polymer or copolymer of vinyl chloride; or from an olefinic polymer such as polyetheylene and may be in a solid or cellular form. Such fusecords were sufficiently water impermeable to be used commercially and did, in fact, experience considerable commercial success. It has been proposed also to modify such fusecord by enclosing the thermoplastic sheath component with additional strands of yarn which had been coated by a hot-melt process with wax which adheres the yarns, which may for example be cellulosic yarns such as rayon, to the thermoplastic sheath which very suitably may be polyethylene.

The fusecords of the prior art and as described generally above are meritorious articles of commerce and for many purposes do not require to be modified. However under certain conditions the prior art fusecords need modification to ensure that they may be used in a more reliable manner. Thus in instances where the fusecord is being used under hot conditions, for example in deep mines or in semitropical or tropical latitudes it has been found that adhesive waxes applied by the hot melt process undergo physical changes so that the surface of the fusecord becomes sticky or tacky, and under very hot conditions such wax components soften sufficiently to make it difficult to thread the fusecord through conventional detonating relay connectors. It has also been found that on exposure to fuel oil, used in conventional ammonium nitrate-fuel oil explosives, certain wax-treated outer strands tend to disintegrate or unwind and thereby producing an unsatisfactory fusecord.

It has now been found that known fusecords may be modified so as to provide improvements in their physical properties such as resistance to abrasion; or in their chemical resistance to the action of salt solutions, such as those obtained by the action of water on ammonium nitrate; or to the effect of contact with carbonaceous materials such as fuel oil; or to the tackifying or surface softening effect induced by comparatively high ambient temperatures; or to the oxidation of the thermoplastic sheath induced by ultraviolet radiation. Such modifications may be achieved if the coating of wax applied by a hot melt technique to the strands enclosing the thermoplastic sheath is replaced by an adhesive coating derived from a water-based composition and which is applied as a water-bearing adhesive to the strands and/or the enclosing thermoplastic sheath in an amount sufficient, and in a manner such, that adhesion between the said strands and the said sheath is obtained.

Accordingly in a general form of the invention there is provided in a fusecord of the kind described and comprising a thermoplastic sheath a part at least of which is enclosed by flexible strands the improvement wherein the said strands are adhered to the said sheath by an adhesive component derived from a water-bearing adhesive composition. Conveniently the thermoplastic sheath may be derived from natural occurring materials or synthetic plastics materials. Compositions comprising synthetic or natural rubbers, flexible polyurethanes, silicone resins or cellulose acetate resins may be used, but these materials are less preferred than are the polyolefins such as homopolymers of ethylene or propylene or their copolymers such as a copolymer of ethylene and vinyl acetate or an alkyl acrylate such as ethyl acrylate or butyl acrylate or an alkyl methacrylate such as methyl methacrylate. Particularly useful materials from which the thermoplastic sheath may be made are compositions comprising polyvinyl chloride especially plasticized polyvinyl chloride compositions.

The flexible strands may take a variety of forms. Thus conveniently they may be in the form of fibres, yarns, braids, tapes, textiles and the like and may be made from one or more components such as in conjugate fibres, or they be in the form of bulked or fibrillated fibres if desired. They may be derived from plant material such as jute or cotton or from cellulosic derivatives such as rayon. It is preferred however that the strands be derived from synthetic plastics material such as for example polyefins, polyamides, polyacrylates or polyesters. Yarns, fibres, tapes or textiles derived from polyethylene or fibrillated polypropylene are useful and such products made from polyester such as polyethylene terephthalate are particularly useful. The flexible strands may be placed in position on the surface of the sheath by conventional means for example by the use of a spun layer and a countering layer of strands or by a braiding operation. When certain types of strands are used, for example when the strands comprise polyethylene, it may be desirable to subject the strands to a treatment, such as a radiation treatment, so as to modify the surface of the strands to enhance the adhering effect of the water bearing adhesive. The strands may also be derived from compositions containing additives, such as for example additives which confer resistance to degradation of the strands to the effect of heat or the effect of light such as ultraviolet light. The surface of the thermoplastic sheath may also be modified such as for example by treatment with radiation or an acidic solution, if desired.

The adhesive component suitably may comprise polymeric or co-polymeric material in water-bearing compositions of the structural adhesive type or of the holding adhesive type. By structural adhesive type is meant a composition wherein the adhesive component holds two adherends and produces high strength in conditions of shear, tension or peel. By holding adhesive type is meant a composition used primarily for attaching one adherend to another and holding it in place without requiring major significance to external stressing. Suitable adhesive compositions include air drying types in which the bonding agents are dispersed or dissolved in a liquid so as to permit the necessary flow during application to the adherend. Such adhesive compositions may be in a variety of physical forms, typically solutions, emulsions, dispersions, pastes or latexes, and it is preferred that the liquid contains water as a major constituent, and preferably as the sole constituent, of the liquid component of the adhesive composition. The nature of the polymeric or copolymeric material will vary to some extent on the nature of the sheath material and the strand material and in choosing the polymeric adhesive component care should be taken to ensure that a suitable bond can be formed between the adherends and the adhesive. Suitable adhesives may be derived from natural products such as gums or rubber, but it is preferred that they comprise synthetic compounds such as synthetic rubbers, epoxy resins, acrylic compounds, and the like. It has been found that adhesives comprising unsaturated compounds are very useful, especially when they contain a vinyl group, and typical compounds of this class include vinyl polymers such as polyvinyl alcohol or polyvinyl acetate or copolymers derived from olefins, typically ethylene, and vinyl acetate. The amount of adhesive components in the composition should be such that the composition can be applied without difficulty to the adherends; and dependent to some extent on the chemical and physical nature of the adhesive components it has been found that adhesive compositions containing from 10 to 80% w/w, preferably from 40 to 60% w/w, of adhesive component are satisfactory.

In an embodiment of the invention there is provided in a process for making a fusecord of the kind described and comprising a thermoplastic sheath a part at least of which is enclosed by flexible strands the improvement wherein the said strands are adhered to the said sheath by treating the surfaces thereof with a water-bearing adhesive composition and removing the liquid component of the said composition. So as to adhere the strands to the sheath it is convenient in one variation of the process of the invention to spin a first layer of strands on the surface of the sheath, apply an amount of adhesive composition to the layer so formed and then, after removing any excess of adhesive composition, to form a counter layer of strands over the applied adhesive composition, and thereafter to dry the product so formed sufficiently to remove the liquid component of the adhesive composition. Suitably such a drying step may be performed in a drying tunnel wherein the partially completed, wet fusecord is passed through gas at an elevated temperature, for example air at a temperature between 90° and 105° C. In other embodiments of the process of the invention an amount of adhesive composition can be applied to the surface of the sheath prior to spinning the first layer of strands, and/or subsequent to forming the counter layer of strands. The adhesive composition may be applied in various ways such as by pneumatic means using shaped nozzles, or by guiding the partially completed fusecord through a reservoir of adhesive composition and controlling the rate of application of the composition by the use of one or more wiper dies. Yet again the adhesive composition may be sprayed on to the appropriate surfaces. The rate of application of the adhesive composition may be varied so as to provide the desired degree of bonding for a range of sizes of strands enclosing a range of sizes of sheaths. As a guide it has been found that a rate of application that provides from about 0.05 to about 5 grams of adhesive component per meter of length of the enclosed sheath is satisfactory for most fusecords.

The fusecords of the invention are similar to fusecords of the prior art with the exception that the adhesive component in contact with the thermoplastic sheath and its enclosing strands is derived from a water-bearing adhesive composition. This modification has led to improvements in the fusecords as described hereinbefore, and additionally it has provided fusecords which facilitate the operation whereby knots may be tied and maintained in a tied condition in the fusecord. There has thus been provided fusecords which have an economic advantage over similar fusecords of the prior art. In mining operations one of the key features which lead to the choice of a fusecord is the ease with which knots may be tied in fusecords and the extent to which such knots remain tight. Thus it is common during blasting operations in large scale mining projects that 500 downlines be tied to a series of trunk-lines on the surface of the mine using clove hitch knots in a one hour period. The time constraint is important since production at, and in the vicinity of, the blast site is at a standstill at the time of blasting and equipment has to be moved to a safe distance from the site. Thus any increase in the rate at which satisfactory knots can be prepared leads to an economic saving in mining operations.

By way of exemplification only, which is not to be construed as limiting, the construction of fusecords according to the invention is hereinafter described with reference to the accompanying drawings wherein.

EXAMPLE 1

This example illustrates a detonating cord according to the invention and having a detonable core component comprising a particulate high explosive material which has been treated with a dialkyl ester of an aromatic dicarboxylic acid and wherein the thermoplastic sheath is derived from a plasticized polyvinyl chloride composition and wherein the flexible strands are polyester yarns.

Figure 1:
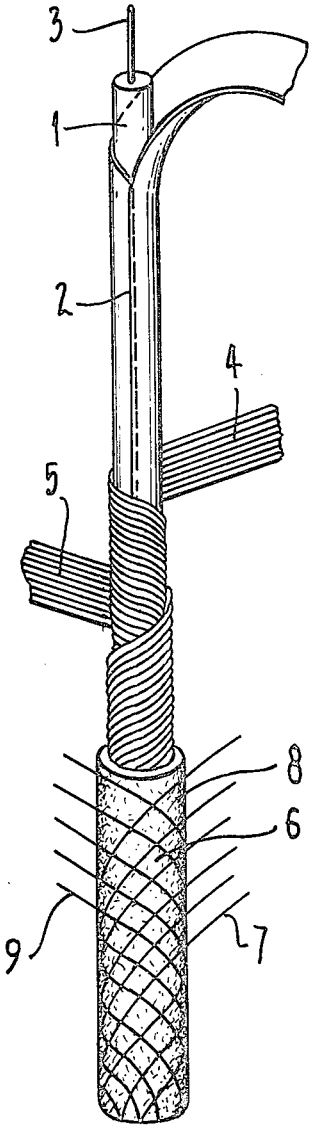
FIG. 1 is a side-elevational view, partially broken away, of a fusecord according to the present invention.

A detonable core component was prepared by adding 2 parts by weight of di-isooctyl phthalate (DIOP) to an agitated slurry of PETN (1000 parts) in aqueous acetone and the mixture so obtained was agitated until the di-isooctyl phthalate was mixed uniformly into the slurry and thereafter the diisooctylphthalate-treated PETN was separated from the slurry to provide a particulate high explosive material which contained approximately 0.2% w/w of DIOP. A detonating cord depicted generally in FIG. 1 was manufactured by a process wherein a detonable core component 1 comprising the particulate high explosive material made above was loaded from a hopper exit at a charge rate of 10 grams per meter into a tube 2 formed by convolution of a tape which was 16 millimeters wide and was fabricated from polyethylene terephthalate and available under the registered trade mark of "Melinex". A yarn material 3 which was formed from two yarns of twisted 470 decatex cotton was trained through the hopper exit and along the axis of the tube 2 to remain within the core 1. The tube 2 was surrounded by a spun layer 4 consisting of 8 yarns of 130 Tex polypropylene helically wound at 30 turns per meter and a countering layer 5 consisting of 10 yarns of 130 Tex polypropylene helically wound at 30 turns per meter. A polyvinylchloride composition, available from ICI Australia Limited under the designation "Welvic" 50390-000 ("Welvic" is a registered trade mark) and containing a low volatility plasticizer, was extruded so as to coat the layer 5 with a layer of the "Welvic" composition to form a thermoplastic sheath 6 which weighed 3 grams per meter and the sheath was surrounded by a spun layer 7 consisting of 10 yarns of 80 Tex polyethylene terephthalate spun yarn helically wound at 46 turns per meter. To spun layer 7 there was applied by pneumatic application through shaped nozzles a water-based adhesive composition having a viscosity of 22 poise and a pH value of 5.3, and available commercially from International Adhesives Pty Ltd of Sydney, Australia under the designation Type 272/1033. The adhesive component comprised a copolymer containing polyvinyl acetate and the composition contained 52% w/w of solids and had a density of 1.07 gram per cubic centimeter. The composition was applied at a rate of 3 grams per meter length of sheath 6. Excess adhesive was removed from the spun layer 7 by passing the partially completed detonating cord through a wiper die, a countering layer 9 consisting of 10 yarns of 80 Tex polyethyleneterephthalate spun yarn helically wound at 46 turns per meter and formed over the applied adhesive composition, and the product so obtained was passed through a drying tunnel, maintained at a temperature in a range from 95° to 105° C., for five minutes to remove the liquid components of the adhesive composition and to leave a bonding amount of adhesive 8 in contact with the sheath 6, and the yarns 7 and 9. The detonating cord so prepared had a surface which was dry to the touch and it could be formed into a reel. This reeled detonating cord and a length of the same cord were stored for four weeks at a temperature in a range from 35° to 40° C. and after this time the surface of the cord was similar to that of the surface of the cord when freshly prepared. The stored detonating cord was knotted easily and the knots remained tight at an inspection eight hours after being made.

EXAMPLE 2

The general procedure of Example 1 was repeated except that in the present example the detonable core component 1 was crystalline PETN loaded at a charge rate of 10 grams per meter of length of tube, and the spun and counter yarns 7 and 9 of Example 1 were replaced by 16 braided yarns of 130 Tex polypropylene which were bonded to the thermoplastic sheath 6 by means of an adhesive component derived from the adhesive composition used in Example 1 and applied to the surface of the sheath 6 at a rate of 5 grams per meter of length of sheath 6. There was thus obtained a detonating cord according to the invention.

EXAMPLE 3

Figure 2:
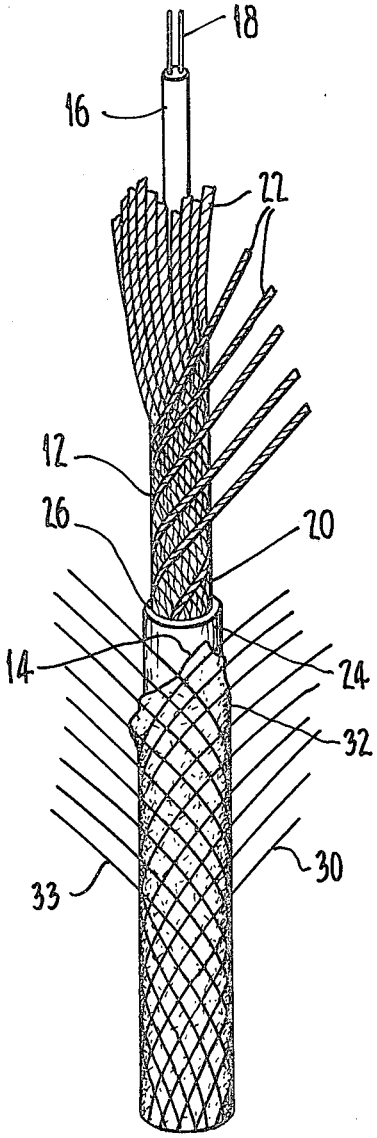
FIG. 2 is a view similar to FIG. 1 showing another embodiment of the present invention; and wherein all parts and percentages are expressed on a weight basis unless otherwise specified.

This example illustrates a safety fuse according to the invention and having a core comprising black powder and wherein the thermoplastic sheath is fabricated from foamed polyethylene and wherein the flexible strands were polyester yarns. A safety fuse depicted generally in FIG. 2 was manufactured by a process wherein a core component 16 comprising black powder was loaded from a hopper exit at a charge rate of 4 grams per meter into a casing 20 which is provided by spinning ten fibres 22 of jute about the core 16 and subsequently forming a second layer of casing 20 by cross-spinning five fibres 22 of glass over the jute. Cotton filaments 18 were trained through the hopper exit and along the axis of casing 20 to remain within core 16. The partially completed product 12 was coated with a polyethylene sheath 14 which had an internal cellular structure 26 and a substantially continuous outer skin 24. The sheath 14 was applied by means used conventionally to extrude polyethylene in the form of a foam on to a substrate. The outer skin 24 of the sheath 14 was treated with the water-based adhesive 32 of Example 1 at a rate of 4 grams of composition per meter length of sheath 14 and a spun layer 30 of polyethylene terephthalate yarns was helically wound over the adhesively treated skin 24. A similar further application of adhesive 32 was made on to the surface of the yarns of spun layer 30 and a similar counter spun layer 33 of polyethylene terephthalate yarns was located over the adhesive 32. The resultant product was passed through a stream of air heated at a temperature at 105° C. to provide a fusecord having a dry surface comprising strands of polyethylene terephthalate bonded to the skin of a thermoplastic sheath by means of a copolymeric component derived from a water-bearing adhesive composition.

EXAMPLES 4 TO 13 INCLUSIVE

In this series of examples the general procedure of Example 1 was repeated except that the adhesive composition of that example was replaced by a range of compositions in which the characterizing adhesive component was as designated in Table 1 and wherein the major ingredient of the carrier component of the composition was water. Table 1 also shows the rate of application of the adhesive composition expressed as grams of composition per meter of sheath length. Each of the detonating cords so produced had surface, reeling, storage and knotting characteristics similar to the corresponding characteristic of the detonating cord of Example 1.

TABLE 1

| Ex. No. | Adhesive component | Application rate grams/meter |
|---|---|---|
| 4 | Polyvinyl alcohol adhesive solution containing 12% w/v solids | 0.7 |
| 5 | Ethylene vinyl acetate copolymeric adhesive "EVA AD 131" available from Plaskem Pty Ltd of Melbourne, Australia | 2.3 |
| 6 | Natural rubber latex adhesive "ADH 6609" available from Davis Fuller Adhesives Pty Ltd of Melbourne, Australia | 2.0 |
| 7 | Synthetic rubber (styrene-butadiene) latex adhesive "ADH 6629" available from Davis Fuller Adhesives Pty Ltd | 2.0 |
| 8 | Ethylene vinyl acetate copclymeric adhesive containing 60% w/v solids | 2.4 |
| 9 | Epoxy resin adhesive containing 71% w/v solids | 2.7 |
| 10 | Polyvinyl acetate/maleate copolymeric adhesive available from Plaskem Pty Ltd as "ADH 781" | 2.1 |
| 11 | Polyvinyl acetate adhesive paste containing 20% w/v solids | 0.6 |
| 12 | Natural rubber latex adhesive paste containing 60% w/v solids | 2.2 |
| 13 | Acrylic latex adhesive containing 45% w/v solids | 2.8 |

EXAMPLES 14 TO 17 INCLUSIVE

In this series of examples the general procedure of Example 1 was repeated except that the thermoplastic sheath was formed from a range of plasticized polyvinyl chloride compositions available from ICI Australia under a designation of "Welvic" followed by a numerical code. These various "Welvic" compositions are referred to in Table 2. In each example the detonating cord so produced had a surface which was dry to the touch, it could be formed into a reel, and had storage and knotting characteristics similar to those of the detonating cord of Example 1.

TABLE 2

| Example No. | Designation of plasticized polyvinyl chloride composition |
|---|---|
| 14 | "Welvic" 57570-000 (contained a polymeric plasticizer) |
| 15 | "Welvic" 57503-115 (contained butyl benzyl phthalate as a plasticizer) |
| 16 | "Welvic" 57601-115 (contained a polymeric plasticizer) |
| 17 | "Welvic" 50390-000 (contained a low volatility plasticizer<br>A small amount of coloring material was also added to this "Welvic" composition. |

EXAMPLES 18 TO 29 INCLUSIVE

In this series of examples the general procedure of Example 1 was repeated except that the thermoplastic sheath was derived from a composition the major component of which is set out in Table 3, which also describes the type of yarn used to prepare both the spun layer 7 and the countering layer 9 each of which layers contained 8 yarns. In each example the detonating cord so produced had a surface which was dry to the touch, it could be formed into a reel and had storage and knotting characteristics similar to those of the detonating cord of Example 1.

TABLE 3

| Example No. | Type of Sheathing | Type of Yarn |
|---|---|---|
| 18 | "Welvic" 50390-000 | Cotton-Bleached, $2/20^s$. |
| 19 | "Welvic" 50390-000 | Polyvinyl acetate - $6/30^s$. |
| 20 | "Welvic" 50390-000 | Twisted rayon - 1100 denier |
| 21 | "Welvic" 50390-000 | Nylon 66 monofilament - 1400 Tex. |
| 22 | "Welvic" 50390-000 | Polyester monofilament - 1100 Tex. |
| 23 | "Welvic" 50390-000 | Polypropylene, UV stabilized, 1300 Tex, as 3 millimeter wide tape |
| 24 | "Welvic" 50390-000 | Polypropylene, 1200 Tex, as 3 millimeter wide tape |
| 25 | Polyethylene stabilized against UV light | Spun polyester of Example 1 |
| 26 | Copolymer of ethylene & vinyl acetate | Spun polyester of Example 1 |
| 27 | Thermoplastic rubber available from Shell Co Ltd | Spun polyester of Example 1 |
| 28 | Polyethylene foam | Spun polyester of Example 1 |
| 29 | Polypropylene | Polypropylene of Example 2 |

We claim:

1. In a fusecord of the kind commonly employed for the transmission of detonation or flame in blasting and prospecting operations and comprising a core of explosive or incendiary material surrounded by non-explosive wrapping material and wherein said wrapped core is encased by a casing comprising a thermoplastic sheath a part at least of which is enclosed by flexible strands the improvement wherein the said strands are adhered to the said sheath by an amount of adhesive component derived from a water-bearing adhesive composition selected from the group consisting of rubber, epoxy resins, acrylic compounds and polymeric vinyl materials.

2. An improved fusecord according to claim 1 wherein the said adhesive composition is selected from the group consisting of latexes, solutions, emulsions, dispersions and pastes.

3. An improved fusecord according to claim 1 wherein the said adhesive component is selected from the group consisting of homopolymeric material and copolymeric material.

4. An improved fusecord according to claim 1 wherein the said rubber is a synthetic rubber.

5. An improved fusecord according to claim 1 wherein the said adhesive component comprises poly(vinyl alcohol).

6. An improved fusecord according to claim 1 wherein the said adhesive component comprises poly(vinyl acetate).

7. An improved fusecord according to claim 1 wherein the said adhesive component constitutes from 10 to 80% w/w of the said adhesive composition.

8. An improved fusecord according to claim 1 wherein the said adhesive component constitutes from 40 to 60% w/w of the said adhesive composition.

9. An improved fusecord according to claim 1 wherein the said fusecord is of a safety fuse type and comprises an incendiary core comprising black powder.

10. An improved fusecord according to claim 1 wherein the said adhesive component is present in an amount in a range from 0.05 to 5 grams per meter length of said sheath.

11. An improved fusecord according to claim 1 wherein the said adhesive component comprises a vinyl copolymer.

12. An improved fusecord according to claim 11 wherein said copolymer comprises poly(vinyl acetate).

13. An improved fusecord according to claim 12 wherein said copolymer is derived from ethylene and vinyl acetate.

14. An improved fusecord according to claim 1 wherein the said fusecord is of a detonating cord type and comprises a core comprising high explosive particles.

15. An improved fusecord according to claim 14 wherein the said fusecord comprises a detonable core component comprising particulate high explosive material which has been treated with a dialkyl ester of an aromatic dicarboxylic acid, and wherein the said thermoplastic sheath is derived from a plasticized polyvinyl chloride composition, and wherein the said flexible strands are polyester yarns, and wherein the said adhesive component is a copolymer comprising poly(vinyl acetate).

16. An improved fusecord according to claim 15 wherein the said high explosive material is pentaerythritol tetranitrate and the said ester is di-isooctylphthalate.

* * * * *